United States Patent [19]

Yarbrough

[11] Patent Number: 5,030,803

[45] Date of Patent: Jul. 9, 1991

[54] OFFSET FLOAT SWITCH

[75] Inventor: Charles J. Yarbrough, Claremont, Calif.

[73] Assignee: General Dynamics Corp., Air Defense Systems Div., Pomona, Calif.

[21] Appl. No.: 391,001

[22] Filed: Aug. 7, 1989

[51] Int. Cl.[5] ..... H01H 35/18

[52] U.S. Cl. ..... 200/84 C; 335/207; 417/40

[58] Field of Search ..... 200/84 R, 84 C, 61.2; 73/308, 313, 319, 322.5; 335/207; 340/623, 624; 417/40, 44

[56] References Cited

U.S. PATENT DOCUMENTS

| | | | |
|---|---|---|---|
| 438,598 | 10/1890 | Ashton . | |
| 2,536,273 | 1/1951 | Gahagan . | |
| 2,736,013 | 2/1956 | Binford . | |
| 2,915,605 | 12/1959 | Friedell . | |
| 2,999,913 | 9/1961 | Friedell . | |
| 3,242,474 | 3/1966 | Gast et al. . | |
| 3,483,342 | 12/1969 | Mauro . | |
| 3,997,744 | 12/1976 | Higo . | |
| 4,142,079 | 2/1979 | Bachman | 200/84 C |
| 4,165,935 | 8/1979 | Bongort | 200/84 C |
| 4,175,435 | 11/1979 | Hara . | |
| 4,442,405 | 4/1984 | Andrejasich et al. . | |
| 4,481,389 | 11/1984 | Johnson | 200/84 C |
| 4,518,835 | 5/1985 | Grossar | 335/207 |
| 4,631,375 | 12/1986 | McCann | 340/624 |

FOREIGN PATENT DOCUMENTS

| | | | |
|---|---|---|---|
| 58926 | 6/1939 | Denmark . | |
| 641479 | 2/1937 | Fed. Rep. of Germany . | |
| 2643355 | 3/1978 | Fed. Rep. of Germany | 200/84 C |
| 2047468 | 11/1980 | United Kingdom . | |

*Primary Examiner*—Gerald P. Tolin

*Attorney, Agent, or Firm*—Henry M. Bissell; Leo R. Carroll

[57] ABSTRACT

A device for use as a float switch device for use in a liquid medium is disclosed which has a magnetic latching feature used to produce an offset, with the switch actuating in a first manner when the liquid level drops to a first level, and actuating in a second manner when the liquid level rises to a second level which is aabove the first level by a selected offset distance. The float element has two buoyant disks on the ends of a hollow cylinder, with switching magnets being located intermediate the two buoyant disks, and latch magnets being located on the bottom of the bottom buoyant disk. The float element slides vertically on a switch stem having a magnetic reed switch therein and a steel washer on the bottom thereof, with the float element being latched in a downward position by the latch magnets until the liquid level rises to the level of the upper buoyant disk, resulting in crisp and precise operation of the switching function.

15 Claims, 2 Drawing Sheets

OFFSET FLOAT SWITCH

This invention was made with Government support under Contract No. N00024-87-C-5433 awarded by the United States Navy. The Government has certain rights in this invention.

BACKGROUND OF THE INVENTION

1. Field of the Invention

The present invention relates generally to a float switch device for use in a liquid medium, and more particularly to a float switch having a magnetic latching feature used to produce an offset, with the switch actuating in a first manner when the liquid level drops to a first level, and actuating in a second manner when the liquid level rises to a second level which is above the first level by a selected offset distance.

2. Description of Related Art

Liquid level sensing float switches have been in use for some time to control the execution of an operation used to maintain liquid level in a reservoir at a desired level or within desired limits. The basic float switch has a float element which is free to move vertically on a support element, with the float controlling the actuation of a switch element as it moves up and down with respect to the support element. When liquid level falls below a set point, the float switch will actuate in a first manner, and when the liquid level rises above the set point the float switch will actuate in a second manner.

Offset may be defined as the distance between the level at which the float switch actuates in the first manner and the level at which the float switch actuates in the second manner. In a typical float switch, there may be very little offset, making the switch highly vulnerable to any kind of turbulence which may occur in the reservoir. It will be appreciated by those skilled in the art that there exist a wide variety of float switches, which are designed to serve more than one function.

For example, a float switch may be used to provide an indication of liquid level within a reservoir. Examples of such float switches are found in U.S. Pat. No. 3,242,474, to Gast et al., in U.S. Pat. No. 3,997,744, to Higo, in U.S. Pat. No. 4,175,435, to Hara, and in U.S. Pat. No. 4,442,405, to Andrejasich et al. The Higo device uses a permanent magnet mounted on a float to operate a magnetic reed switch, and the Andrejasich et al. device has a float which moves close to a fixed permanent magnet to operate a magnetic reed switch. As such, both of these devices will have virtually no offset, since a magnetic reed switch has perhaps one-sixteenth of an inch offset.

The Hara device, like the Higs reference, uses a permanent magnet mounted on a float to operate a magnetic reed switch. In one embodiment, the Hara reference has four such switches located in a vertical array to indicate various liquid levels in the reservoir. The Gast et al. device uses a permanent magnet in the float to repel a second permanent magnet on the switch, thereby closing the switch. While Gast et al. states that this in theory will reduce the susceptibility of the device to turbulence, in practice the Gast et al. device is not really superior to any of the other switches described above.

Other references in addition to the alternative embodiment of Hara cite the use of multiple float mechanisms to indicate multiple levels. Specifically, such references include U.S. Pat. No. 438,598, to Ashton, U.S. Pat. No. 2,536,273, to Gahagan, U.S. Pat. No. 2,736,013, to Binford, and U.S. Pat. No. 3,483,342, to Mauro. The Ashton device has two float switches, one of which alarms if the liquid level is too high, and the other of which alarms if the liquid level is too low. The Gahagan device also has two float switches, one of which is used to monitor liquid level, and the other of which is a density responsive switch used to detect the presence of water in a lubricant reservoir.

The Binford reference teaches a device having two interconnected float switches to provide indications of low and high liquid level, respectively. The Mauro reference likewise uses a plurality of float switches, with low and high switches being used in an oil reservoir, and a low water switch being used in a water reservoir. All of these devices have only a very small amount of offset, and they are designed for use primarily as level indicators.

Another desirable use of a float switch is to control the operation of a pump which drains liquid from a reservoir, as in the case of a sump pump. When the liquid level in the reservoir falls below a low set point, the switch turns the pump off. When the liquid level in the reservoir rises above a high set point, the switch turns the pump back on to pump liquid from the reservoir. Conversely, operation of a pump may also be controlled by a float switch to pump liquid into a reservoir to maintain liquid level at a desired level. In either event, in order for the system to function properly, there must be a sufficient degree of offset between the low set point and the high set point.

If there is not a sufficient degree of offset, several problems arise in the system. First, it will be apparent to those skilled in the art that if there is any turbulence whatsoever in the reservoir, systems having only a minimal offset will repeatedly cycle on and off, an undesirable effect. Secondly, if there is only a small offset in liquid level between switch cycling, the pump will be run very frequently.

For example, consider a sump pump or a similar system. The pump will shut off when the low set point is reached. As soon as the high set point is reached, the pump will be turned on again, with little time between pumping cycles and very short pumping cycles. It is apparent that such a system will be very hard on the pump, reducing its operating life. Even more seriously, if there is only a small offset distance, the pump could cycle on, pump enough liquid to cycle off, and have sufficient liquid backflow into the reservoir to cycle the pump on again. This situation would result in a continuously cycling pump, an undesirable effect.

A system may overcome these problems by using two float switches and a relay system to cycle the pump on and off. In this case, one of the float switches is set for the high set point, and the other is set for the low set point. The relay system cycles the pump on, for example, at the high set point, and off at the low set point.

Alternatively, a system may use a mechanical system to perform the same function. One such reference is found in U.K. Patent Application 2,047,468A, to Weston. A magnetic reed valve is used, with the small offset being mechanically multiplied by the design of the system. Two floats are used, with the mechanical tolerances being critical and requiring precise adjustment. In addition, since a magnetic reed switch is still used, the system will remain highly susceptible to turbulence in the liquid in the reservoir. As a result, the actuation of the Weston device is not crisp and positive.

Two other references of interest are shown in U.S. Pat. No. 2,915,605, and in U.S. Pat. No. 2,999,913, both to Friedell, and both illustrating the same two devices. The first device illustrated by the Friedell references uses a single float with magnetic attraction between a permanent magnetic collar in the float and a permanent magnet in the supporting shaft. The device includes a double pole, double throw switch, and cycles between closing one set of contacts and the other. The device is free from the problem of cycling due to turbulence, but it offers only a limited amount of offset. In addition, it is mechanically complex, having over twenty parts. As such, it is likely to be expensive and difficult to manufacture.

The other device illustrated in the two Friedell references uses two floats, with the lower float having the same permanent magnetic collar/permanent magnet arrangement as described above. When the liquid level is sufficiently high to float the upper float, near the top of the reservoir, a rod connected to the upper float will lift the lower float, freeing the magnetic coupling between the lower float and its support. Otherwise, the upper and lower floats are not connected together. This system is also mechanically complex, with even more parts than the other Friedell system described above. As such, it will also be mechanically complex and expensive to manufacture.

It is accordingly the primary objective of the present invention that it provide a float switch which may be used to control the operation of a pump, and that it provide a substantial degree of offset in operation between the high and low set points. It is desirable that in addition to being able to provide a substantial amount of offset, it be susceptible to manufacture as a device having any desired amount of offset. It is a further objective that the float switch of the present invention be constructed to operate only a single switch element, thus eliminating the requirement for a control system such as relays.

The operation of the float switch of the present invention in cycling from off to on and from on to off must be both crisp and positive, with the points at which it will switch being absolutely certain. The float switch should be able to operate in a reservoir where it may experience a degree of turbulence, with the turbulence not substantially affecting the operation of the device. In addition, it must be absolutely free from undesirable oscillations between the on and off states caused by turbulence or small changes in liquid level in the reservoir.

It is also an objective that the float switch of the present invention be as mechanically simple as possible, having a single moving float element. It should have as few parts as possible, both moving and fixed, to make its construction simple and its operation dependable and long-lasting. It should also be of inexpensive construction, thereby giving it an economic advantage over more mechanically complex devices. It is also an objective that all of the aforesaid advantages and objectives be achieved without incurring any substantial relative disadvantage.

SUMMARY OF THE INVENTION

The disadvantages and limitations of the background art discussed above are overcome by the present invention. With this invention, a float switch is constructed using a single float element consisting of two buoyant disks respectively attached to the top and bottom ends of a hollow tube to form an assembly resembling a barbell. One or more switch magnets are mounted on the outside of the hollow tube at a location intermediate the two buoyant disks. One or more latch magnets are mounted on the bottom of the bottom buoyant disk to complete the float element.

The float element is mounted with the hollow tube in a vertical orientation on a vertically installed hollow switch stem, with the float element being free to slide up and down on the switch stem A steel washer is mounted on the bottom of the switch stem for contact with the latch magnets on the bottom of the bottom buoyant disk. A retainer washer is also mounted on the top of the switch stem to retain the float element on the switch stem. Completing the assembly of the float switch is a normally closed magnetic reed switch mounted in the interior of the switch stem for actuation by the switch magnets located on the hollow tube intermediate the buoyant disks.

The float switch is installed in a reservoir with the magnetic reed switch being connected in a circuit to operate a pump. With a low level of liquid in the reservoir, the float element will be fully down, with the latch magnets on the bottom of the bottom float disk contacting the steel washer located on the bottom of the switch stem. The magnetic reed switch is actuated by the switch magnets at this time, so it is in an open position (pump off). As the liquid level in the reservoir rises, the float element will remain unmoved even when the liquid level is over the bottom buoyant disk.

When the liquid level reaches the middle of the top buoyant disk, the float element will be lifted off of the steel washer on the bottom of the switch stem, breaking the contact of the latch magnets on the steel washer. The float element will move rapidly up the switch stem, removing the switch magnets on the hollow tube intermediate the buoyant disks from the proximity of the magnetic reed switch and permitting the closure of the reed switch (pump on). The liquid level will begin to fall, with the float element slowly coming down the switch stem. When the latch magnets on the bottom of the bottom buoyant disk are sufficiently close to the steel washer, they will rapidly pull the float element down onto the steel washer, actuating the magnetic reed switch while the float element is moving rapidly downward. The switch will thus be opened (pump off) by the latch magnets.

It will thus be perceived that the float switch of the present invention has a substantial amount of offset in its operation, with the exact amount of offset being determined by the length of the hollow tube used in the float element. The actuation of the magnetic reed switch is sure and crisp, with the high and low set points being settable with a high degree of precision.

Two alternative embodiments are included in the present invention. First, the latch magnets could be used on the top of the top buoyant disk, with the retainer washer on the top of the switch stem being made of steel or an alternative ferrous material. Secondly, latch magnets could be included both on the bottom of the bottom buoyant disk and on the top of the top buoyant disk. Operation of both of these alternative embodiments will be understood by those skilled in the art to be similar to the operation of the preferred embodiment discussed above.

It may therefore be seen that the present invention teaches a float switch which may be used to control the operation of a pump, and that it provides a substantial degree of offset in operation between the high and low set points. In addition to being able to provide a substantial amount of offset, it is susceptible to manufacture as a device having any desired amount of offset. The float switch of the present invention is further constructed to operate only a single switch element, thus eliminating the requirement for a control system such as relays.

The operation of the float switch of the present invention in cycling from off to on and from on to off is both crisp and positive, with the points at which it will switch being absolutely certain. The float switch is able to operate in a reservoir where it may experience a degree of turbulence, with the turbulence not substantially affecting the operation of the device. In addition, it is absolutely free from undesirable oscillations between the on and off states caused by turbulence or by small changes in liquid level in the reservoir.

The float switch of the present invention is also as mechanically simple as possible, and has only a single moving float element. It has as few parts as possible, with only the float element moving, thereby making its construction simple and its operation dependable and long-lasting. It is also of inexpensive construction, thereby giving it an economic advantage over more mechanically complex devices. Finally, all of the aforesaid advantages and objectives are achieved without incurring any substantial relative disadvantage.

BRIEF DESCRIPTION OF THE DRAWING

A better understanding of the present invention may be realized from a consideration of the following detailed description, taken in conjunction with the accompanying drawing in which.

DETAILED DESCRIPTION OF THE PREFERRED EMBODIMENT

Figure 2:
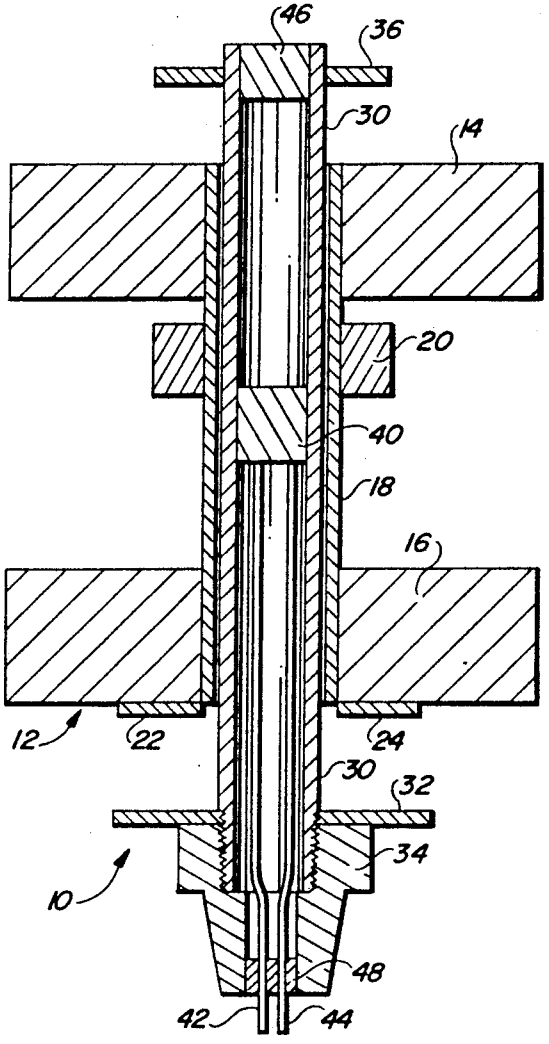
FIG. 2 is a cutaway view of the float switch of the present invention, showing the construction thereof.
Figure 1:
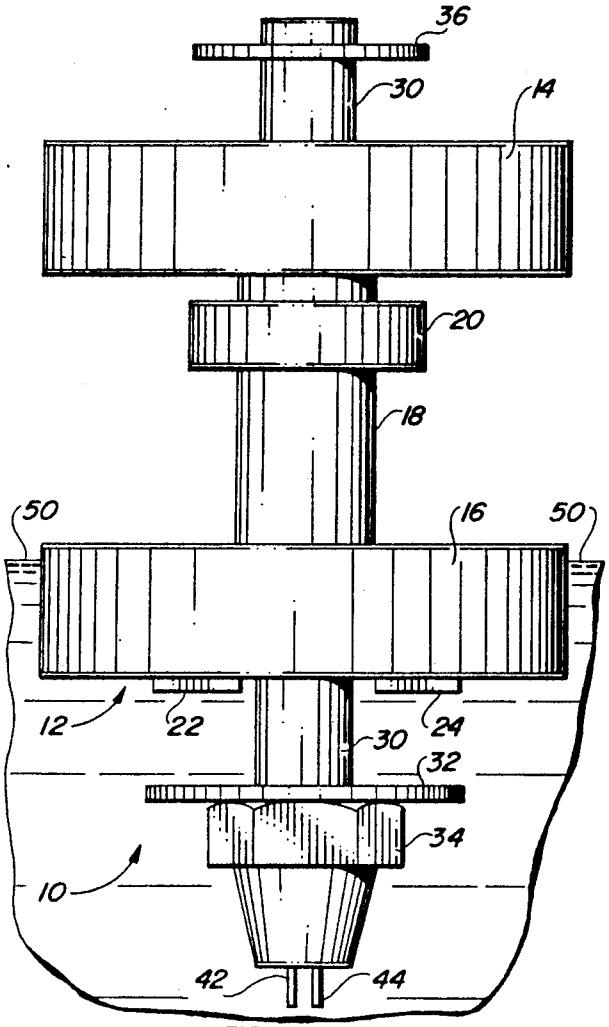
FIG. 1 is a plan view from the side of the preferred embodiment of the float switch of the present invention, with the liquid level at its lowest point prior to magnetic latching and the switch actuating in a first manner.

The preferred embodiment of the present invention is illustrated in FIGS. 1 and 2, which show a float switch 10 for use in a liquid reservoir to control the operation of a pump used to lower the liquid level to keep it between a high level set point and a low level set point. It will be appreciated by those skilled in the art that the float switch 10 may be easily modified to raise the liquid level to keep it between the high level set point and the low level set point.

The float switch 10 consists of two basic elements, one of which is moveable with liquid level, and the other of which remains in a fixed position. The moveable portion of the float switch 10 is a float element 12 which moves, within limits, vertically in a liquid reservoir (not shown). The float switch 10 of the present invention uses a single unitary float element 12, unlike many float switches discussed in the art above which required two or more float elements.

The float element 12 uses for buoyancy a top buoyant disk 14 and a bottom buoyant disk 16, both of which are in the preferred embodiment disk-shaped. The larger the diameters of the top buoyant disk 14 and the bottom buoyant disk 16 are, the more precise will be the latching and unlatching operations, which are discussed below. The top buoyant disk 14 and the bottom buoyant disk 16 are preferably made of a buoyant material which is inert to the liquid in which the float switch 10 is to be used.

The other basic component of the float element 12 is a hollow tube 18 located between the top buoyant disk 14 and the bottom buoyant disk 16. The top buoyant disk 14 is mounted at one end of the hollow tube 18, and the bottom buoyant disk 16 is mounted at the other end of the hollow tube 18. The top buoyant disk 14 and the bottom buoyant disk 16 are mounted so that the hollow tube 18 is orthogonal to them. The float element 12 thus has a configuration which resembles a barbell. The disk-shaped configuration of the top buoyant disk 14 and the bottom buoyant disk 16 on the float element 12 allows for a maximum offset, as will become apparent below.

An annular switch magnet 20 is fixedly mounted on the outside of the hollow tube 18 at a location intermediate the top buoyant disk 14 and the bottom buoyant disk 16. The switch magnet 20 may be mounted on the hollow tube 18 using an adhesive which will not be affected by the liquid in which the float switch 10 is to be used. It should be noted that the switch magnet 20 may have a configuration other than annular, or more than one magnet could be substituted for the single switch magnet 20 used in the preferred embodiment.

Two latch magnets 22 and 24 are mounted on the bottom of the bottom buoyant disk 16 at locations just outside the diameter of the hollow tube 18. The latch magnets 22 and 24 are preferably mounted using an adhesive which will not be affected by the liquid in which the float switch 10 is to be used. Alternatively, the magnets may be mounted by mechanical attaching means such as by screwing, rivetting, etc. Note that instead of the two latch magnets 22 and 24, a single annular latch magnet could also be used. Alternatively, more than two latch magnets could also be used on the bottom of the bottom buoyant disk 16.

The fixed portion of the float switch 10 is designed to be installed in a liquid reservoir, with the float element 12 mounted moveably thereon. Specifically, a hollow switch stem 30 having an outside diameter smaller than the inner diameter of the hollow tube 18 is installed in a vertical orientation in a liquid reservoir (not shown) in a manner conventional in the art. The float element 12 is free to move up and down on the outer diameter of the switch stem 30.

A steel washer 32 is fixedly mounted near the bottom of the switch stem 30 using a nut 34 or by brazing or otherwise bonding in place. The steel washer 32 serves a dual function in that it represents a stop for downward travel of the float element 12 and a contact for the latch magnets 22 and 24 to latch onto. As such, the steel washer 32 has an outer diameter which is sufficiently large to contact all of the bottom surfaces of the latch magnets 22 and 24. Note that the washer 32 must be made of a magnetizable material so that the latch magnets 22 and 24 will exert an attractive force thereon.

A retainer washer 36 is fixedly attached to the switch stem 30 near the top thereof, thereby preventing the float element 12 from coming off of the top of the switch stem 30. A magnetic reed switch 40 is fixedly mounted inside the switch stem 30 in a position intermediate the two ends thereof. In the example being discussed herein in conjunction with the preferred embodiment, the magnetic reed switch 40 is a normally closed switch, which will open when a magnet is in close proximity. The magnetic reed switch 40 is located in the switch stem 30 for actuation by the switch magnet 20 on the hollow tube 18 of the float element 12.

Two wires 42 and 44 extend from the magnetic reed switch 40 in a downward direction, and exit the switch stem 30 through the bottom end thereof. A plug 46 is located in the inner diameter of the switch stem 30 at the top thereof to seal the top of the switch stem 30. Similarly, a plug 48 is located in the inner diameter of the switch stem 30 at the bottom thereof to seal the bottom of the switch stem 30, with the wires 42 and 44 extending through the plug 48. The magnetic reed switch 40 is thus sealed within the switch stem 30.

The operation of the float switch 10 may now be described in conjunction with FIGS. 1 and 3–5. The float switch 10 may be placed in a liquid reservoir (not shown) with the wires 42 and 44 from the magnetic reed switch 40 being connected in a drive circuit for a pump (not shown). In the example used herein, when the magnetic reed switch 40 is in a closed position, the pump will be operated to pump liquid out of the reservoir (not shown). When the magnetic reed switch 40 is in an open position, the pump will not be operated, thus allowing the liquid level in the reservoir (not shown) to rise. The reed switch 40 may be closed (or opened) by either the upward or downward motion of the float, as desired.

Figure 3:
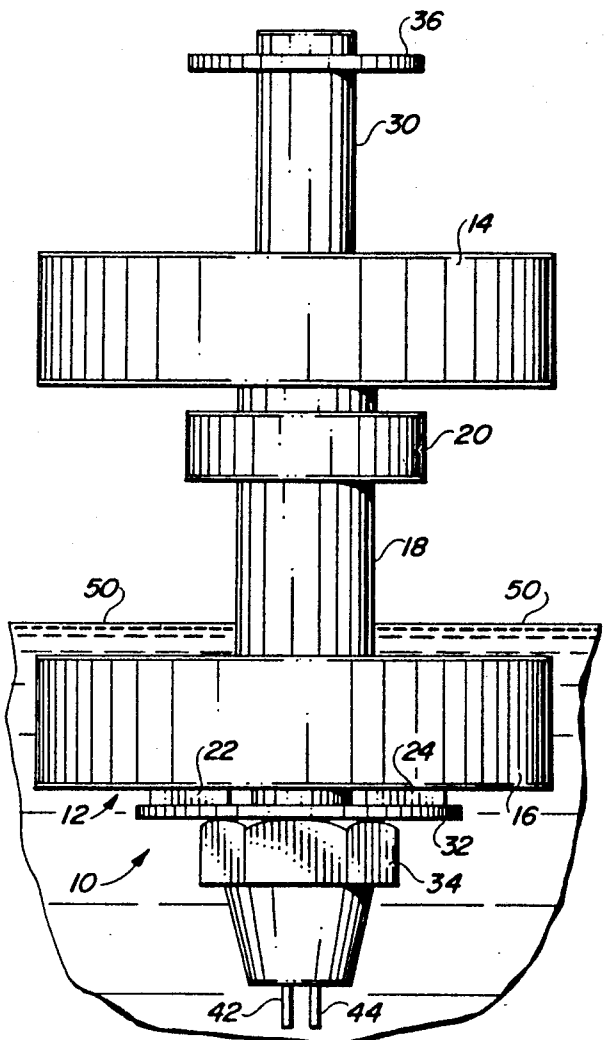
FIG. 3 is a plan view from the side of the float switch shown in FIGS. 1 and 2, with the float element in its magnetically latched position and the liquid level intermediate the top and bottom buoyant disks.
Figure 4:
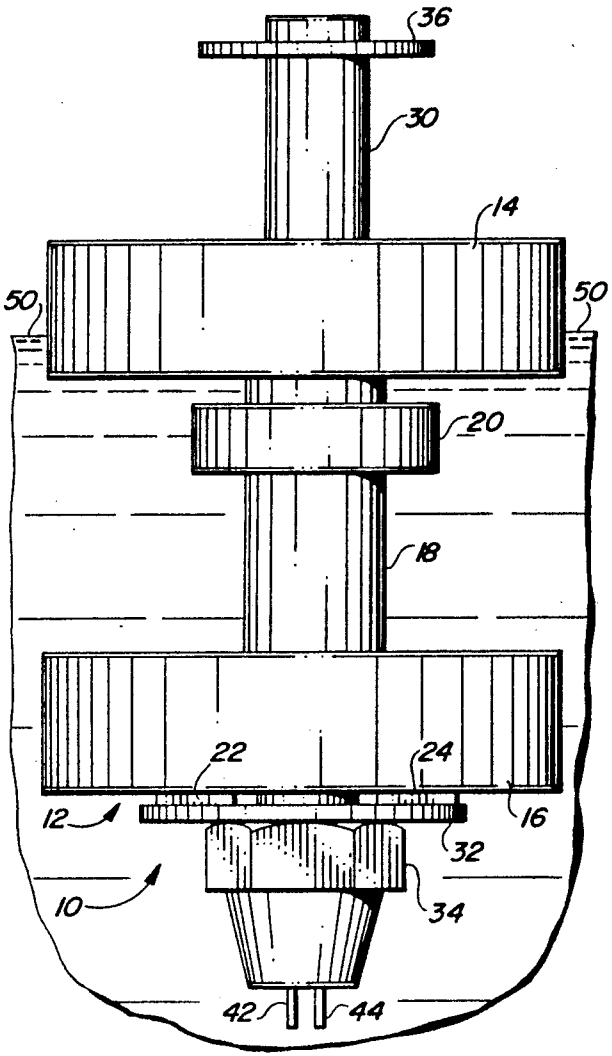
FIG. 4 is a plan view from the side of the float switch shown in FIGS. 1 through 3, with the float element in its magnetically latched position and the liquid level at its highest point prior to magnetic unlatching and the switch actuating in a second manner.

The position of the float element 12 may be described in one of two ways. First, when the latch magnets 22 and 24 on the bottom of the bottom buoyant disk 16 of the float element 12 are in contact with the steel washer 32 (as shown in FIGS. 3 and 4), the float element 12 is said to be in a latched position. Alternatively, when the latch magnets 22 and 24 on the bottom of the bottom buoyant disk 16 of the float element 12 are not in contact with the steel washer 32 (as shown in FIGS. 1 and 5), the float element 12 is said to be in an unlatched position.

When the float element 12 is an unlatched position, the float element 12 will float on liquid 50 in the reservoir as shown in FIG. 1. When the float element 12 is floating freely on the liquid 50, the liquid level will be below the top of the bottom buoyant disk 16, also as shown in FIG. 1. This is because in the preferred embodiment the buoyancy of the bottom buoyant disk 16 is more than sufficient to support the entire float element 12.

Figure 5:
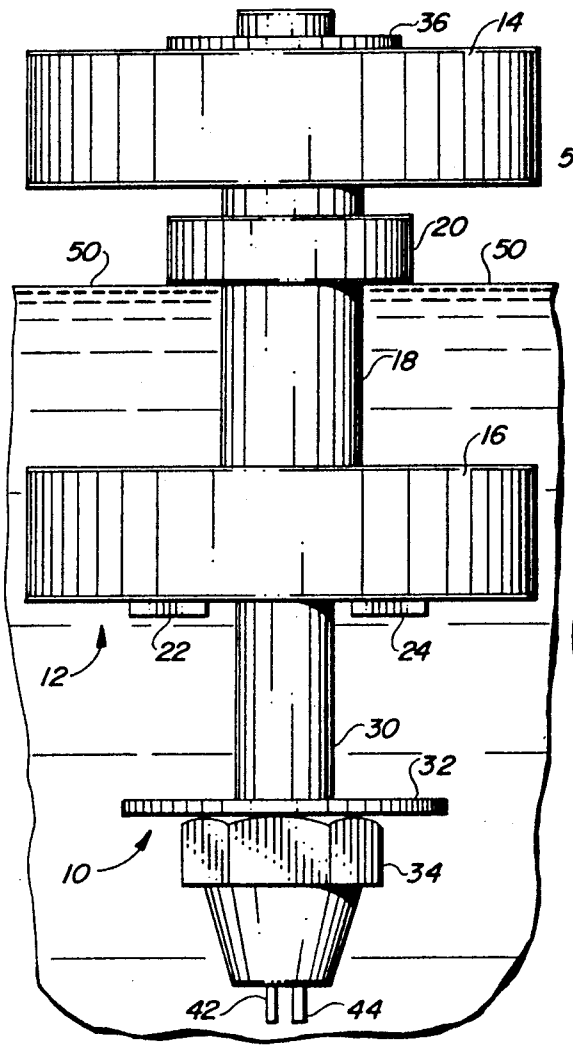
FIG. 5 is a plan view from the side of the float switch shown in FIGS. through 4, with the float element in its magnetically unlatched position and the liquid level intermediate the top and bottom buoyant disks.

Thus, the float element 12 will float on the liquid 50 as shown in FIG. 1, until the float element 12 contacts the retainer washer 36 at the top of the switch stem 30, as shown in FIG. 5. When the top buoyant disk 14 of the float element 12 contacts the retainer washer 36, further upward movement of the float element 12 is inhibited, and the liquid level may continue to rise without further movement of the float element 12.

Returning to the position shown in FIG. 1, the level of the liquid 50 is just above the point where the magnetic force exerted by the latch magnets 22 and 24 on the steel washer 32 will exceed the buoyant force of the float element 12. At this point, the float element 12 will continue to float on the liquid 50 as the liquid 50 is being pumped out of the reservoir. When the float element 12 is in the position shown in FIG. 1, the switch magnet 20 on the float element 12 is just above the position at which it would actuate the magnetic reed switch 40 (FIG. 2). If the level of the liquid 50 drops even slightly from the level shown in FIG. 1, the float element 12 will move from its unlatched position to the latched position shown in FIG. 3.

When the liquid level falls slightly from the level shown in FIG. 1 due to operation of the pump (not shown), the magnetic force exerted by the latch magnets 22 and 24 on the steel washer 32 exceeds the buoyant force of the float element 12. The float element 12 is quickly pulled downwardly until the latch magnets 22 and 24 on the bottom of the bottom buoyant disk 16 on the float element 12 contact the steel washer 32, as shown in FIG. 3. As the float element 12 is rapidly moving from its unlatched position shown in FIG. 1 to the latched position shown in FIG. 3, the magnetic reed switch 40 will be actuated by the switch magnet 20 on the float element 12.

It is thus important to note that the magnetic reed switch 40 (FIG. 2) is actuated by the switch magnet 20 on the float element 12 as the float element 12 is moving from its unlatched position to its latched position. In the latched position shown in FIG. 3, the switch magnet 20 on the float element 12 continues to actuate the magnetic reed switch 40 (FIG. 2). In its actuated position, the magnetic reed switch 40 is open, turning off the pump, and allowing the reservoir to refill.

Thus, the level of the liquid 50 will begin to rise again. However, the float element 12 will remain in its latched position, allowing the level of the liquid 50 to come up to the bottom of the top buoyant disk 14, as shown in FIG. 4. The buoyancy of the float element 12 with the level of the liquid 50 at the point shown in FIG. 4 is insufficient to break the hold of the latch magnets 22 and 24 on the steel washer 32. However, if the level of the liquid 50 rises beyond the level shown in FIG. 4, the buoyant force exerted by the float element 12 will exceed the force exerted by the latch magnets 22 and 24 on the steel washer 32.

As the level of the liquid 50 rises slightly from the level shown in FIG. 4, the buoyant force exerted by the float element 12 exceeds the force exerted by the latch magnets 22 and 24 on the steel washer 32. As this occurs, the float element 12 rises rapidly due to the buoyant force, attempting to move up to the liquid level shown on the float element 12 in FIG. 1. Prior to this occurring, the top buoyant disk 14 will contact the retainer washer 36, stopping movement of the float element 12 in the position shown in FIG. 5.

Thus, the float element 12 moves from the latched position shown in FIG. 4 to the unlatched position shown in FIG. 5. As the float element 12 is rising from the latched position, the switch magnet 20 will move away from proximity to the magnetic reed switch 40 (FIG. 2), causing the magnetic reed switch 40 to return to its normally closed position. The pump (not shown) is thus turned on again, causing the level of the liquid 50 to begin to drop. The float element 12 will thus float on the liquid 50 in an unlatched position until the level of the liquid 50 again drops below the level shown in FIG. 1, causing the float element 12 to again move to its latched position.

It may thus be perceived by those skilled in the art that the float switch 10 of the present invention has a substantial amount of offset in its operation. The exact amount of offset is thus determined by the length of the hollow tube 18 used in the float element 12. For greater offset distances, the length of the hollow tube 18 is increased proportionally. The actuation of the magnetic reed switch 40 in the float switch 10 of the present invention is sure and crisp, with the high and low set points being settable with a high degree of precision.

Figure 6:
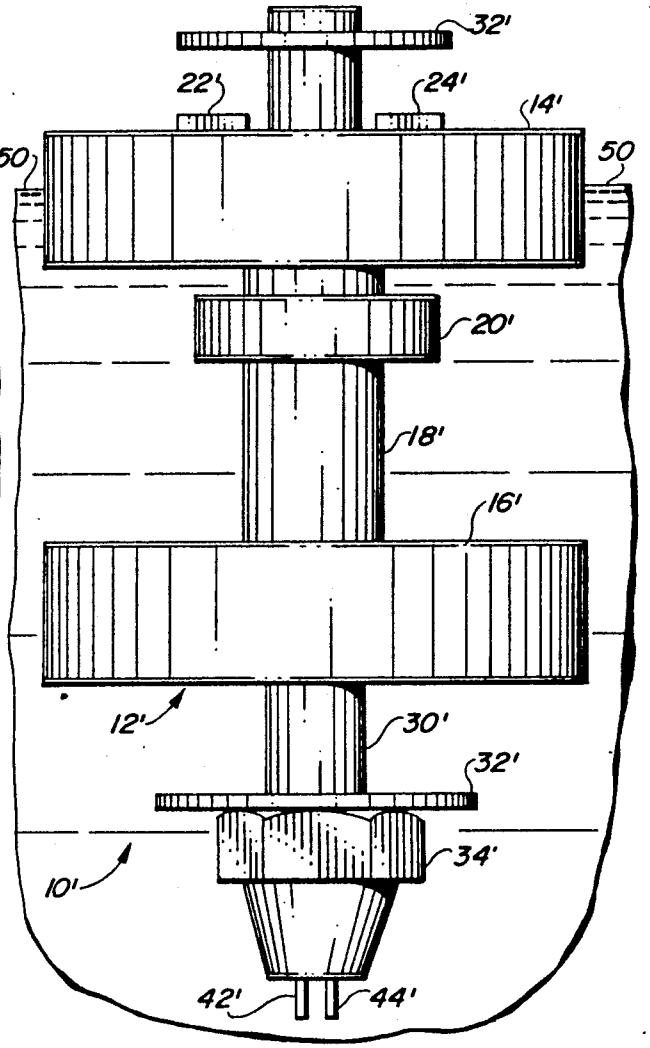
FIG. 6 is a plan view from the side of a first alternative embodiment of the present invention.

Two alternative embodiments are included in the present invention. The first alternative embodiment is shown in FIG. 6, with corresponding features being identified with a reference numeral with a prime mark. Two latch magnets 22' and 24' are used on the top of the top buoyant disk 14' , with a steel washer 32' being installed near the top of the switch stem 30'. In this case, the float element 12' is heavier, floating with the level of the liquid 50 being near the halfway mark on the top buoyant disk 14'.

If the level of the liquid 50 goes any higher than as shown in FIG. 6, the float element 12' will be drawn upward into a latched position. Once in a latched position, the float element 12' would remain latched until the level of the liquid 50 fell down to approximately the halfway mark on the bottom buoyant disk 16', when the weight of the float element 12' would pull it into an unlatched position.

In a second alternative embodiment, latch magnets could be included both on the bottom of the bottom buoyant disk 16 and on the top of the top buoyant disk 14. Operation of both of these alternative embodiments will be understood by those skilled in the art to be similar to the operation of the preferred embodiment and the first alternative embodiment, both of which are discussed above.

It may therefore be appreciated from the above detailed description of the preferred embodiment of the present invention that it teaches a float switch which may be used to control the operation of a pump (or any circuit to be responsive to fluctuating liquid levels). In so doing, it provides a substantial degree of offset in operation between the high and low set points. In addition to being able to provide this substantial degree of offset, it may be manufactured as a device having any amount of offset desired. The float switch of the present invention requires only a single switch element, thus eliminating the requirement for a control system dependent upon electrical relays.

The operation of the float switch of the present invention in cycling from off to on and from on to off is both crisp and positive, with the points at which it will switch being certain. The float switch is able to operate in a reservoir where it may experience turbulence, with such turbulence not substantially affecting the operation of the device. In addition, the float switch is absolutely free from any undesirable oscillations between on and off states caused by turbulence or by small changes in liquid level in the reservoir.

The float switch of the present invention is thus as mechanically simple as possible, and has only a single moving float element. It has as few parts as possible, with only the float element itself moving, thereby making its construction simple and its operation dependable. It is of inexpensive construction, thereby providing an economic advantage over more mechanically complex devices.

Although there have been shown and described hereinabove specific arrangements of an offset float switch in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considerd to be within the scope of the invention as defined in the annexed claims.

What is claimed is:

1. A float switch which operates with an offset between liquid levels producing on and off switch actuations, said float switch comprising:

a first buoyant member;

a second buoyant member;

first support means for supporting said first and second buoyant members thereon in an integral float assembly, said support means having a top end and a bottom end, said first buoyant member being mounted on said support means at said bottom end thereof, said second buoyant member being mounted on said support means at said top end thereof;

a first magnet mounted directly to and on a side of said first buoyant member facing away from said second buoyant member;

a second magnet mounted on said support means intermediate said first and second buoyant members and movable with said integral float assembly;

second support means for supporting said float switch, said first support means being mounted on said second support means for longitudinal movement with respect to said second support means;

magnetically responsive switch means fixedly mounted on said second support means in a position to be actuated by movement of said second magnet to a position adjacent the switch means; and a segment of magnetizable material fixedly mounted on one end of said second support means in a position facing said first magnet for releasably latching said float assembly in a lowermost position.

2. A float switch which operates with an offset between liquid levels producing on and off switch actuations, said float switch comprising:

a vertically-oriented hollow support shaft;

a buoyant float element mounted for longitudinal movement on said support shaft, said buoyant float element having a non-buoyant portion bearing an actuating magnet intermediate the top and bottom thereof;

a first magnet mounted directly to an outer surface of and at the bottom of said buoyant float element;

a segment of magnetizable material fixedly mounted directly to an outside surface of said support shaft at the bottom thereof; and a switch fixedly mounted within said hollow support shaft for actuation by longitudinal movement of said buoyant float element and actuating magnet with respect to said support shaft.

3. A float switch as defined in claim 1, wherein said buoyant float element comprises a first buoyant member; a second buoyant member; and support means for supporting said first and second buoyant members thereon, said support means having a first end and a second end, said first buoyant member being mounted on said support means at said first end thereof, said second buoyant member being mounted on said support means at said second end thereof.

4. A float switch as defined in claim 2, wherein said support means comprises a hollow tube having said first buoyant member attached at one end thereof and said second buoyant member attached at the other end thereof.

5. A float switch as defined in claim 4, wherein said support shaft is essentially cylindrical, said hollow tube fitting over said support shaft in moveable fashion with said first buoyant member at the bottom of said support shaft and said second buoyant member at the top of said support shaft, said first magnet being mounted on the bottom of said first buoyant member.

6. A float switch as defined in claim 5, wherein said segment of magnetizable material comprises a steel washer mounted on the bottom of said support shaft.

7. A float switch as defined in claim 4, wherein said first buoyant member has sufficient buoyancy to support said float element in a liquid with the liquid level near the top of said first buoyant member.

8. A float switch as defined in claim 7, wherein said first magnet exerts sufficient attractive force on said segment of magnetizable material to draw said first buoyant member below the level of liquid and said first magnet into contact with said segment of magnetizable material when said first magnet is within a first distance of said segment of magnetizable material, thereby actuating said switch in a first manner.

9. A float switch as defined in claim 8, wherein said first magnet exerts sufficient attractive force on said segment of magnetizable material, when said first magnet is in contact with said segment of magnetizable material, to overcome the buoyancy of said first buoyant member and part of the buoyancy of said second buoyant member, the combined buoyancy of said first and second buoyant members being sufficient to overcome the attractive force said first magnet exerts on said segment of magnetizable material, thereby enabling said float member to move upward, disengaging said first magnet from said segment of magnetizable material and actuating said switch in a second manner.

10. A float switch as defined in claim 9, wherein said switch when actuated in said first manner is open, and when actuated in said second manner is closed.

11. A float switch as defined in claim 5, wherein said switch is a magnetically operable reed switch.

12. A float switch as defined in claim 11, wherein said support shaft is hollow and said magnetically operable reed switch is located inside said support shaft.

13. A float switch as defined in claim 3, wherein said first and second buoyant members are essentially disk shaped.

14. A float switch as defined in claim 13, wherein said support means is essentially orthogonal to said first and second buoyant members.

15. A float switch as defined in claim 1, additionally comprising means, mounted at the top of said support shaft, for retaining said float element on said support shaft.

* * * * *